US007685845B2

(12) United States Patent
Lonati et al.

(10) Patent No.: US 7,685,845 B2
(45) Date of Patent: Mar. 30, 2010

(54) CIRCULAR KNITTING MACHINE FOR HOSIERY OR THE LIKE

(75) Inventors: Ettore Lonati, Botticino (IT); Tiberio Lonati, Brescia (IT); Fausto Lonati, Brescia (IT); Jan Ando, Brno (CZ)

(73) Assignee: Lonati S.p.A., Brescia (IT)

( * ) Notice: Subject to any disclaimer, the term of this patent is extended or adjusted under 35 U.S.C. 154(b) by 0 days.

(21) Appl. No.: 12/225,914

(22) PCT Filed: Mar. 27, 2007

(86) PCT No.: PCT/IB2007/000864

§ 371 (c)(1),
(2), (4) Date: Dec. 1, 2008

(87) PCT Pub. No.: WO2007/113649

PCT Pub. Date: Oct. 11, 2007

(65) Prior Publication Data

US 2009/0165503 A1 Jul. 2, 2009

(30) Foreign Application Priority Data

Mar. 31, 2006 (IT) ..... MI2006A0628
Jul. 14, 2006 (IT) ..... MI2006A1378

(51) Int. Cl.
*D04B 15/00* (2006.01)

(52) U.S. Cl. ..... 66/216

(58) Field of Classification Search ..... 66/8, 66/57, 215–220, 222, 223

See application file for complete search history.

(56) References Cited

U.S. PATENT DOCUMENTS

| | | | | |
|---|---|---|---|---|
| 3,678,710 | A | 7/1972 | Ando | |
| 4,541,253 | A * | 9/1985 | Luchi et al. | 66/14 |
| 5,367,893 | A * | 11/1994 | Fucik | 66/222 |
| 5,425,252 | A * | 6/1995 | Lonati | 66/219 |
| 5,520,024 | A | 5/1996 | Ando | |
| 6,220,061 | B1 | 4/2001 | Ando | |
| 6,609,395 | B2 * | 8/2003 | Ando | 66/57 |
| 2003/0101775 | A1 | 6/2003 | Ando | |

FOREIGN PATENT DOCUMENTS

| | | |
|---|---|---|
| EP | 0 677 605 | 1/1999 |
| EP | 1 010 790 | 6/2000 |
| WO | WO 02/42536 | 5/2002 |

OTHER PUBLICATIONS

International European Search report for PCT/IB2007/000864.

* cited by examiner

*Primary Examiner*—Danny Worrell
(74) *Attorney, Agent, or Firm*—Husch Blackwell Sanders Welsh & Katz

(57) ABSTRACT

A circular knitting machine for hosiery or the like, comprises at least one needle cylinder with vertical axis and has, on its lateral surface, a plurality of axial slots, each of which accommodates a needle and an element for actuating the needle. The actuation element comprises at least one connecting element and a selector. The connecting element is provided with a radially actuatable movable heel, and the selector protrudes with a portion between the bottom of the axial slot and the connecting element in any operative position of the machine. The selector is oscillatable on a radial plane of the needle cylinder to produce oscillation of the connecting element and extract its movable heel from the axial slot to achieve engagement with connecting element actuation cams facing the lateral surface of the needle cylinder.

30 Claims, 7 Drawing Sheets

CIRCULAR KNITTING MACHINE FOR HOSIERY OR THE LIKE

TECHNICAL FIELD

The present invention relates to a circular knitting machine for hosiery or the like.

BACKGROUND ART

Single-cylinder and double-cylinder circular knitting machines for hosiery or the like are known.

Single-cylinder circular knitting machines comprise substantially a needle cylinder which has a vertical axis and on the lateral surface of which there are a plurality of axial slots, each of which accommodates a needle which can be actuated with an alternating motion along the corresponding axial slot in order to form knitting. The needle is provided generally with a heel which protrudes radially from the corresponding axial slot of the needle cylinder, and the needle is actuated by providing a plurality of needle actuation cams which are arranged around the needle cylinder and define, as a whole, paths which are shaped with rising portions, parking or horizontal portions, and descending portions, which can be followed by the heel of the needles when the needle cylinder is actuated with a rotary motion about its own axis with respect to the needle actuation cams.

Double-cylinder circular knitting machines for hosiery generally comprise a lower needle cylinder which has a vertical axis and an upper needle cylinder which is arranged above and coaxially with respect to the lower needle cylinder, such cylinders being actuatable rigidly with each other with a rotary motion about the common axis.

A plurality of axial slots are formed on the lateral surface of the lower needle cylinder and on the lateral surface of the upper needle cylinder. The axial slots of the upper needle cylinder are aligned with the axial slots of the lower needle cylinder. A slider is accommodated in each of the axial slots of the lower needle cylinder and in each of the axial slots of the upper needle cylinder. Between the two needle cylinders, i.e., in the knitting region, in each of the axial slots there is a needle which is provided with two tips or heads, respectively an upper head and a lower head; depending on whether one wishes to provide plain stitches or purl stitches, such needle is moved into the lower needle cylinder so that its knits with its upper tip or into the upper needle cylinder so that its knits with its lower tip.

Since the needle does not have a heel, it is actuated by means of the slider arranged in the lower needle cylinder or by means of the slider arranged in the upper needle cylinder, depending on whether it has to form plain or purl stitches.

The sliders currently used in double-cylinder circular knitting machines for hosiery are constituted generally by an elongated laminar body, which has a first longitudinal side designed to rest on the bottom of the axial slot formed on the lateral surface of the lower needle cylinder or on the lateral surface of the upper needle cylinder.

Such sliders are further provided with two heels, which are mutually spaced along the longitudinal extension of the slider and protrude transversely from a second longitudinal side of the slider which lies opposite the first longitudinal side.

These heels are used to produce the movement of the slider along the corresponding axial slot of the lower or upper needle cylinder so as to cause the actuation of the needle associated with said slider in the various types of knitting of the machine or to transfer the needle from one needle cylinder to the other.

The slider is further provided, on its first longitudinal side, i.e., on its side directed towards the bottom of the axial slot within which it is accommodated, with a hook-shaped tab, which engages the lower head of the needle or the upper head depending on whether the slider is in the lower needle cylinder or in the upper needle cylinder.

Around the lateral surface of the lower needle cylinder and around the lateral surface of the upper needle cylinder there are a plurality of slider actuation cams, which define a series of paths with which the heels of the sliders engage when the needle cylinders are actuated with a rotary motion about their axis with respect to said cams. The paths defined by the cams are shaped so as to cause the movement of the sliders along the axial slots of the needle cylinders in which they are accommodated and consequently cause the actuation of the needles that are associated therewith.

In order to vary the actuation of each needle and therefore vary the type of knitting that the needle produces, it is necessary to actuate the transfer of its heel or of the heel of the slider that actuates it from one path to another path of the corresponding actuation cams, and this is achieved generally by providing, inside each axial slot, below the needle in single-cylinder circular machines or below the slider in the lower needle cylinder in double-cylinder circular machines, a sub-needle or selector, which is also provided with one or more heels which can protrude radially from the lateral surface of the needle cylinder in order to engage selector actuation cams which are also arranged around the lateral surface of the needle cylinder in single-cylinder circular machines or of the lower needle cylinder in double-cylinder circular machines.

The selectors can generally oscillate on the radial plane of the needle cylinder on which they lie in order to pass from an active position, in which they protrude from the corresponding axial slot of the needle cylinder or of the lower needle cylinder with at least one of their heels so as to engage the selector actuation cams, to an inactive position, in which they are embedded with their heel or heels within the corresponding axial slot so as not to engage the selector actuation cams, or vice versa.

The selector actuation cams have rising portions and descending portions so as to cause, as a consequence of the rotation of the needle cylinder about its own axis with respect to the selector actuation cams, when a heel of a selector engages them, the rising movement of the needle or of the slider that lies above in order to produce its direct actuation or the transfer of its heel from one path to another among the paths defined by the needle actuation cams or by the slider actuation cams or to allow the descending movement of the needle or of the slider which is usually caused by the needle actuation cams or by the slider actuation cams.

The passage of the selectors from the active position to the inactive position is actuated by means of selection devices which laterally face the needle cylinder of the machine and which, by means of the selectors, are capable of varying the actuation of the needles and therefore of varying the knitting that can be produced.

In currently commercially available circular machines, the intervention of the selectors, by means of the selection devices and the selector actuation cams, in order to cause a variation of the path followed by the heels of the needles or of the sliders, can occur only in certain conditions of mutual arrangement of the selector and the needle or the slider that is in the same axial slot, and this imposes severe constraints and limitations in the design of the set of actuation cams of the needles or sliders and selectors.

In currently commercially available circular machines, in order to overcome these limitations and increase the operating possibilities of the machines, very often, between the needle actuation cams and between the slider actuation cams there are also additional cams which can move on command, with respect to the fixed element that supports them, known as cam box, along a radial direction with respect to the needle cylinder, so as to pass from an active position, in which they are close to the needle cylinder in order to be engaged by the heels of the needles or of the sliders, to an inactive position, in which they are spaced from the needle cylinder so as to not interfere with the heels of the needles or of the sliders and vice versa.

The presence of these movable cams and of the corresponding actuators, which is necessary in order to produce the various kinds of knitting, has the problem of increasing considerably the complexity of the structure of the entire machine.

Moreover, the presence of these movable cams forces the provision, on board the machine, of an appropriately provided actuation program, which intervenes if an accidental stop of the machine occurs due to a lack of electric power supply and restores the correct position of the movable cams before knitting resumes, since if the machine were to restart without first restoring the correct position of the movable cams the heels of the needles or of the sliders might break.

In practice, the presence of these movable cams makes it necessary to provide the machine with electronic programs which store the position of the movable cams when the electric power supply is interrupted, and this constitutes a further complication in the manufacture of the machine.

DISCLOSURE OF THE INVENTION

The aim of the present invention is to solve the problems described above by providing a circular knitting machine for hosiery or the like which can operate correctly with a limited number of movable cams for the actuation of the needles or of the sliders or with no movable cams at all.

Within the scope of this aim, an object of the invention is to provide a machine in which the set of needle or slider actuation cams is simplified considerably with respect to known types of machine.

Another object of the invention is to provide a machine which despite a simplification of the needle or slider actuation cams still allows to perform the usual types of knitting that are possible in circular knitting machines for hosiery or the like of the traditional type.

This aim and these and other objects, which will become better apparent hereinafter, are achieved by a circular knitting machine for hosiery or the like, which comprises at least one needle cylinder which has a vertical axis and has, on its lateral surface, a plurality of axial slots, each of which accommodates a needle and a needle actuation element, characterized in that said actuation element comprises:

at least one connecting element, which is provided, on its side directed toward the outside of the needle cylinder, with at least one movable heel; said connecting element being able to oscillate on a radial plane of the needle cylinder for the transfer of said movable heel from an active position, in which said movable heel protrudes radially from the corresponding axial slot of the needle cylinder to engage corresponding cams for actuating the connecting elements which face the lateral surface of the needle cylinder and define paths which can be followed by said movable heel, in the active position, as a consequence of the actuation of the needle cylinder with a rotary motion about its own axis with respect to said connecting element actuation cams, to an inactive position, in which said movable heel is contained in said axial slot of the needle cylinder so as to not engage said connecting element actuation cams, and vice versa; and a selector which has a portion which protrudes between said connecting element and the bottom of the axial slot of the needle cylinder in which it is accommodated in any position which can be assumed by said connecting element during the operation of the machine; said selector being able to oscillate on a radial plane of the needle cylinder in order to actuate the transfer of said movable heel of the connecting element from said inactive position to said active position.

BRIEF DESCRIPTION OF THE DRAWINGS

Further characteristics and advantages of the invention will become better apparent from the description of two preferred but not exclusive embodiments of the machine according to the invention, illustrated by way of non-limiting example in the accompanying drawings, wherein:

FIG. 1 is a schematic axial sectional view of a portion of the needle cylinder of the machine with the movable heel of the connecting element in the inactive position;

FIG. 2 is a schematic sectional view, taken as in FIG. 1, of a portion of the needle cylinder of the machine with the movable heel of the connecting element in the active position;

FIG. 3 is a schematic axial sectional view of a portion of the needle cylinders of the machine with the movable heel of the connecting element in the inactive position;

FIG. 4 is a schematic sectional view, taken as in FIG. 3, of a portion of the needle cylinders of the machine with the movable heel of the connecting element in the active position;

FIG. 5 is a view of a possible embodiment of the set of actuation cams of the needle actuation elements, projected flat and taken from its side directed toward the needle cylinders, marking the path followed by the heels of an actuation element of a needle when the corresponding needle must be excluded from knitting;

FIG. 6 is a view of the set of actuation cams of the needle actuation elements, similar to FIG. 5, marking the path followed by the heels of an actuation element of a needle when the corresponding needle must form knitting at a feed or drop;

FIG. 7 is a view of the set of actuation cams of the needle actuation elements, similar to FIG. 5, marking the path followed by the heels of an actuation element of a needle when the corresponding needle must form knitting at a feed or drop with an actuation of the needle cylinder with a direction of rotation which is the opposite of the one of FIG. 6;

FIG. 8 is a view of the set of actuation cams of the needle actuation elements, similar to FIG. 5, marking the path followed by the heels of the actuation elements of a needle during the transfer of the needle from the upper needle cylinder to the lower needle cylinder;

FIG. 9 is a view of the set of actuation cams of the needle actuation elements, similar to FIG. 5, marking the path followed by the heels of the actuation elements of a needle during the transfer of the needle from the lower needle cylinder to the upper needle cylinder.

WAYS OF CARRYING OUT THE INVENTION

Figure 1:
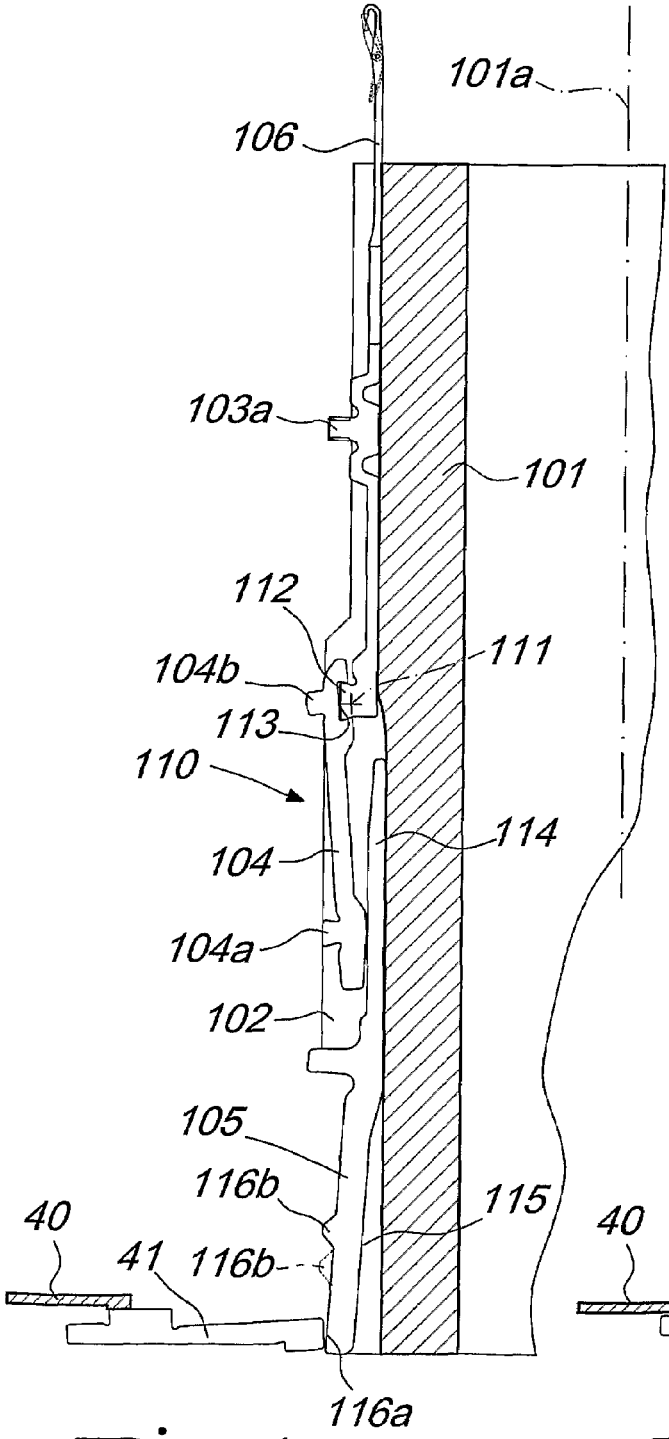
FIGS. 1 and 2 are views of a first embodiment of the machine according to the invention, constituted by a single-cylinder circular knitting machine for hosiery or the like, more particularly.
Figure 2:
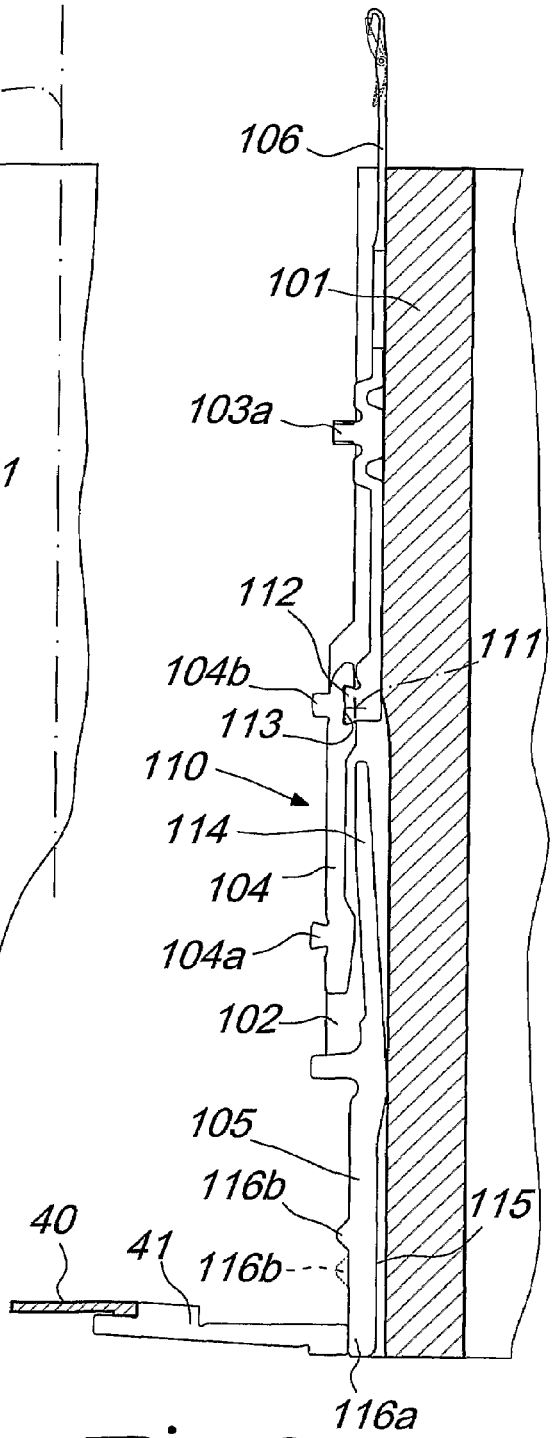
Figure 3:
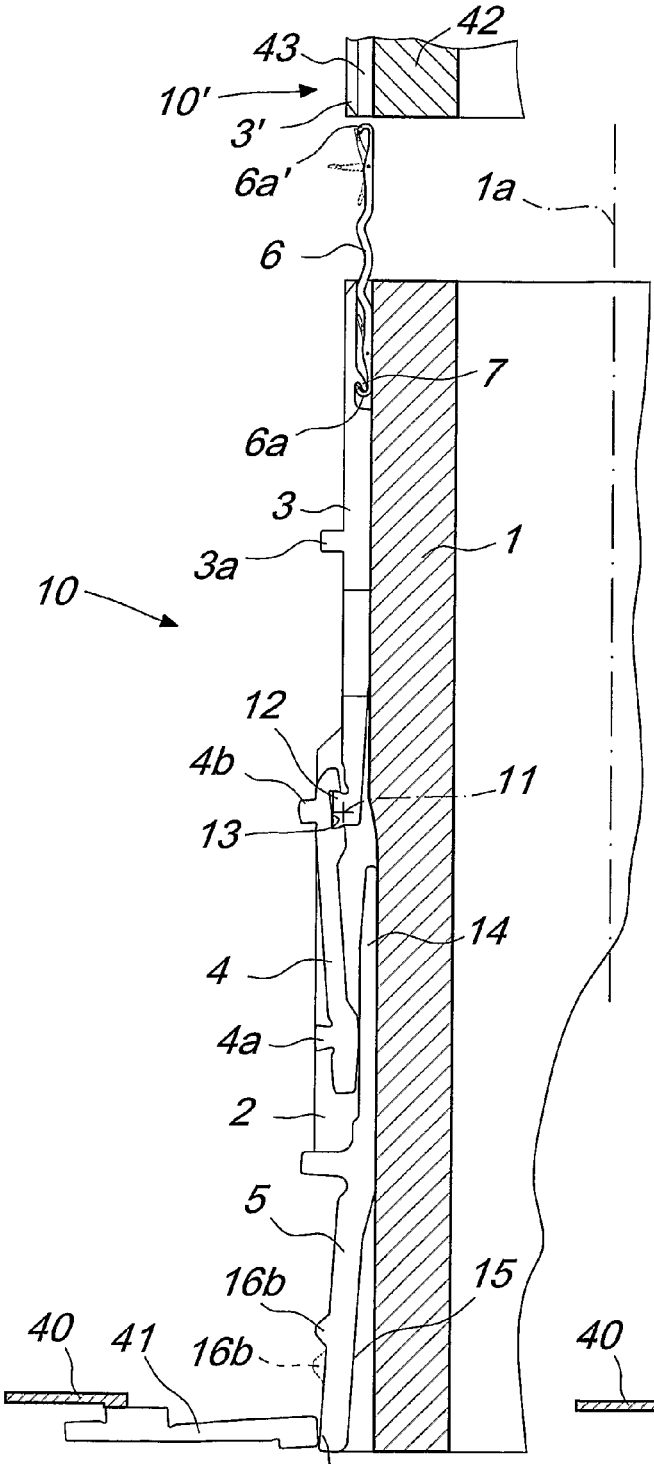
FIGS. 3 to 9 are views of a second embodiment of the machine according to the invention, constituted by a double-cylinder circular knitting machine for hosiery or the like, more particularly.
Figure 4:
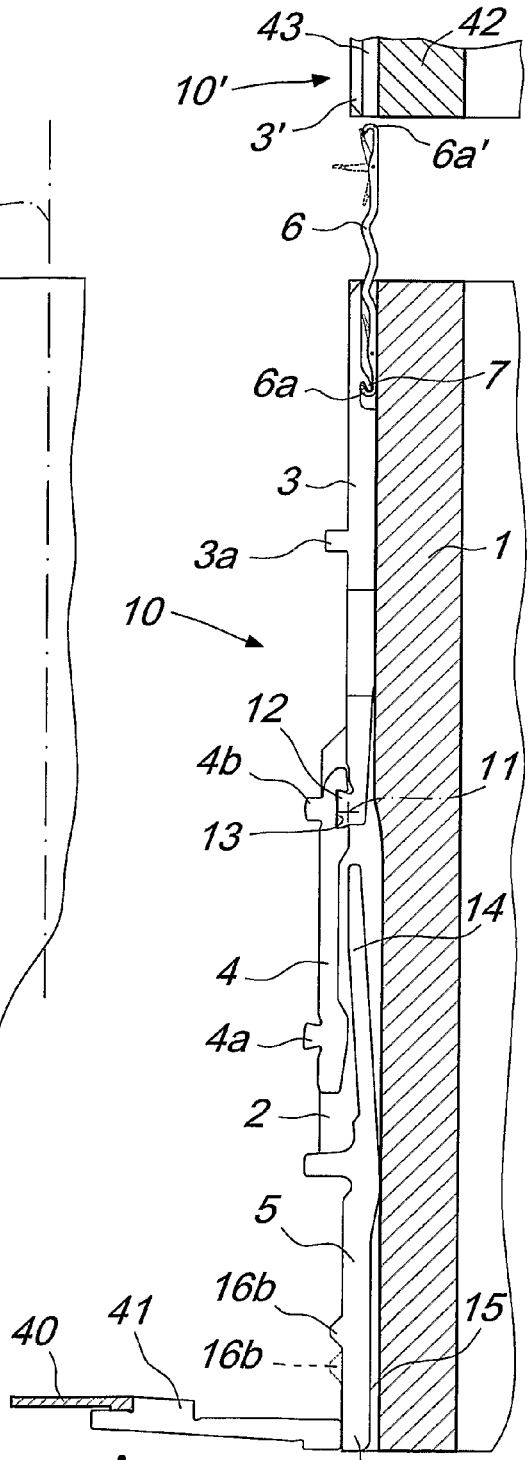

With reference to the first embodiment shown in FIGS. 1 and 2, which refers to a single-cylinder circular knitting machine for hosiery, the machine according to the invention comprises a needle cylinder 101, which has a vertical axis 101*a* and has, on its lateral surface, a plurality of axial slots 102, each of which accommodates a needle 106 and an actuation element 110 for the needle 106.

According to the invention, the actuation element 110 comprises at least one connecting element 104 which is provided, on its side directed toward the outside of the needle cylinder 101, with at least one movable heel 104*a*. The connecting element 104 can oscillate on a radial plane of the needle cylinder 101 in order to cause the transfer of the movable heel 104*a* from an active position, shown in FIG. 2, in which the movable heel 104*a* protrudes radially from the corresponding axial slot 102 of the needle cylinder 101 in order to engage corresponding connecting elements actuation cams which face the lateral surface of the needle cylinder 101 and define paths which can be followed by the movable heel 104*a*, in the active position, as a consequence of the actuation of the needle cylinder 101 with a rotary motion about its own axis 101*a* with respect to the actuation cams of the connecting elements, to an inactive position, shown in FIG. 1, in which the movable heel 104*a* is contained in the axial slot 102 of the needle cylinder 101 so as to not engage the actuation cams of the connecting elements, and vice versa.

The actuation element 110 also comprises a selector 105, which is provided with an elongated laminar body and has a portion 114 which protrudes between the connecting element 104 and the bottom of the axial slot 102 of the needle cylinder 101, in which it is accommodated, in any position which can be assumed by the connecting element 104 during the operation of the machine so that it is always possible to act, by means of the selector 105, on the connecting element 104. The selector 105 can oscillate on a radial plane of the needle cylinder 101 to cause the oscillation of the connecting element 104 in the direction of oscillation which produces the transfer of the movable heel 104*a* of the connecting element 104 from the inactive position to the active position.

The connecting element 104 has an elongated laminar body and is connected to the longitudinal end of the needle 106 which lies opposite the tip or head of the needle 106.

Preferably, the connecting element 104 is pivoted to the needle 106 about a pivoting axis 111, which is perpendicular to the radial plane, i.e., to the plane of arrangement of the connecting element 104 which is inserted in the axial slot 102. The connecting element 104 can oscillate about said pivoting axis 111 with respect to the needle 106 in other to produce the transfer of the movable heel 104*a* from the active position to the inactive position or vice versa.

The needle 106 has, in an intermediate region of its longitudinal extension, a fixed heel 103*a* which protrudes radially from the corresponding axial slot 102 of the needle cylinder 101 and can engage needle actuation cams which face the lateral surface of the needle cylinder 101 and define paths which can be followed by the fixed heel 103*a* as a consequence of the actuation of the needle cylinder 101 with a rotary motion about its own axis 101*a* with respect to the needle actuation cams.

One possible embodiment of the connecting element actuation cams and of the needle actuation cams is described hereinafter.

In the embodiment shown in FIGS. 1 and 2, the connecting element 104 is pivoted directly to the needle 106, but as an alternative it might be pivoted to an intermediate element arranged between the connecting element 104 and the needle 106, which are arranged in the same axial slot 102 of the needle cylinder 101. In this case, the intermediate element might be connected to the needle 106, preferably with a bilateral connection, so as to transmit to the needle 106 an alternating movement parallel to the axis 101*a* of the needle cylinder 101. In this case, the connecting element 104 would be pivoted to the intermediate element about a pivoting axis which is perpendicular to the radial plane so as to be able to oscillate about said pivoting axis with respect to the intermediate element for the transfer of the movable heel 104*a* from the active position to the inactive position or vice versa.

The connecting element 104 is pivoted to the needle 106 or to the intermediate element about the pivoting axis 111, proximate to a longitudinal end thereof, and the movable heel 104*a* lies proximate to the opposite longitudinal end of the connecting element 104.

The pivoting between the connecting element 104 and the needle 106 or the intermediate element is constituted preferably by a protrusion 112, which protrudes on the side of the needle 106 or intermediate element which is directed in the opposite direction with respect to the bottom of the axial slot 102 in which it is accommodated, and by a seat 113 which accommodates, so that it can rotate about the axis 111, the protrusion 112 and is formed in the connecting element 104.

In this manner, a bilateral connection is established between the needle 106 or intermediate element and the connecting element 104 in the sliding movement of the needle 106 or intermediate element and of the connecting element 104 along the axial slot 102, produced by the engagement of the needle 106 or of the intermediate element or of the connecting element 104 with the corresponding actuation cams.

Preferably, the connecting element 104 has, at its end connected to the needle 106 or intermediate element, a second heel 104*b*, which protrudes radially toward the outside of the needle cylinder 101. This second heel 104*b* protrudes constantly from the lateral surface of the needle cylinder 101 and in the specific case can be used as a grip element of the assembly constituted by the needle 106, by the optional intermediate element and by the connecting element 104 in order to replace it during machine maintenance.

With reference to the second embodiment shown in FIGS. 3 to 9, which refers to a double-cylinder circular knitting machine for hosiery, the machine according to the invention comprises a lower needle cylinder 1, which has a vertical axis 1*a*, and an upper needle cylinder 42, which is arranged upward and coaxially with respect to the lower needle cylinder 1. A plurality of mutually aligned axial slots 2, 43 are formed on the lateral surface of the lower needle cylinder 1 and on the lateral surface of the upper needle cylinder 42. An actuation element 10, 10' for a needle 6 is accommodated in each of the axial slots 2, 43 of the lower needle cylinder 1 and of the upper needle cylinder 42, and a needle 6 with a double head or tip is arranged proximate to the mutually facing axial ends of the needle cylinders 1, 42 in one of the needle cylinders 1, 42.

At least the actuation element 10 arranged in the lower needle cylinder 1, referenced hereinafter as "lower actuation element", comprises a slider 3, which is provided, proximate to one of its longitudinal ends, with means for engaging a head of the needle 6, and a connecting element 4, similar to the connecting element 104, which is pivoted to the longitudinal end of the slider 3 which lies opposite the end that can engage the needle 6.

Substantially, the slider 3 can be likened conceptually to the intermediate element considered above in the first embodiment of the machine according to the invention.

The lower actuation element 10 comprises, below the connecting element 4, a selector 5 which can oscillate, on a radial plane of the needle cylinder 1, in order to cause the oscillation of the connecting element 4 with respect to the slider 3 in the direction of oscillation that produces the transfer of the movable heel 4*a* of the connecting element 4 from the inactive position to the active position, as will be described in greater detail hereinafter.

A corresponding actuation element 10' or upper actuation element for a needle 6 when said needle is arranged in the upper needle cylinder 42 is accommodated within each axial slot 43 of the upper needle cylinder 42. Preferably, said upper actuation element 10' comprises, from the bottom upward, a slider 3', a connecting element 4' and a selector 5', which are preferably provided like the ones that will be described hereinafter with reference to the lower needle cylinder 1. The upper needle cylinder 42, as regards the axial slots and the elements accommodated therein cited above, is provided substantially like the lower needle cylinder 1 but in an inverted position. For this reason, in FIGS. 3 and 4 the upper needle cylinder 42 has been shown only partially.

The needle 6 is provided with two tips or heads 6*a*, 6*a*', respectively a lower head 6*a* and an upper head 6*a*', and depending on whether one wishes to provide plain stitches or purl stitches it is transferred to the lower needle cylinder 1 so that it knits with its upper tip 6*a*' or to the upper needle cylinder 42 so that it knits with its lower tip 6*a*.

Since the needle 6 does not have a heel, it is actuated by means of the lower actuation element 10 or by means of the upper actuation element 10' depending on whether it is to form plain stitches or purl stitches.

The sliders 3, the connecting elements 4 and the selectors 5 arranged in the axial slots 2 of the lower needle cylinder 1 of the machine according to the invention will be described hereinafter, and this description applies preferably also to the sliders 3', to the connecting elements 4' and to the selectors 5' arranged in the axial slots 43 of the upper needle cylinder 42, taking of course into account the fact that the position of the elements 3', 4', 5' is inverted with respect to the position of the elements 3, 4 and 5 and that the slider 3 can engage the lower head 6*a* of the needle 6 while the slider 3' can engage the upper head 6*a*' of the needle 6.

The slider 3 has an elongated laminar body which is provided, proximate to its longitudinal end directed toward the needle 6, in a per se known manner, with engagement means, constituted by a hook-shaped tab 7, which can engage the lower head 6*a* of the needle 6.

The slider 3 has a first longitudinal side which is directed toward the bottom of the corresponding axial slot 2 and, on its opposite longitudinal side, a fixed heel 3*a* which lies substantially at right angles to the first longitudinal side of the slider 3, i.e., radially with respect to the lower needle cylinder 1, and protrudes radially from the lateral surface of the lower needle cylinder 1 in order to engage slider actuation cams 8 which face the lateral surface of the lower needle cylinder 1.

The slider 3 has, on its first longitudinal side, proximate to its lower end, an inclined portion which allows it to oscillate on a radial plane of the lower needle cylinder 1 in order to engage or disengage the lower head 6*a* of the needle 6 by virtue of the hook-shaped tab 7.

The connecting element 4 has an elongated laminar body and is connected to the longitudinal end of the slider 3 which lies opposite with respect to the end that can engage the needle 6. The connecting element 4 has, on its side directed toward the outside of the lower needle cylinder 1, at least one movable heel 4*a*.

The connecting element 4 can oscillate on a radial plane of the lower needle cylinder 1 with respect to the slider 3 in order to cause the transfer of its movable heel 4*a* from an active position, in which the movable heel 4*a* protrudes radially from the corresponding axial slot 2 in order to engage connecting element actuation cams 9, to an inactive position, in which the movable heel 4*a* is contained in the corresponding axial slot 2 so as to not engage the connecting element actuation cams 9, and vice versa.

The connecting element 4 is preferably pivoted, by means of its upper longitudinal end, to the lower longitudinal end of the slider 3 which lies opposite with respect to the end that can engage the needle 6, about a pivoting axis 11 which is perpendicular to the radial plane of arrangement of the connecting element 4. Pivoting is preferably performed by means of a protrusion 12 which lies on the side of the slider 3 which is directed away from the bottom of the axial slot 2 and by a seat 13 which accommodates rotatably said protrusion 12 and is formed in the connecting element 4.

In this manner, a bilateral connection is established between the slider 3 and the connecting element 4 in the sliding motion of the slider 3 and of the connecting element 4 along the axial slot 2 produced by the engagement of the slider 3 or of the connecting element 4 with the corresponding actuation cams 8, 9.

Conveniently, the connecting element 4 has, at its end connected to the slider 3, a second heel 4*b*, which protrudes radially toward the outside of the lower needle cylinder 1. This second heel 4*b* can be pushed toward the bottom of the axial slot 2 in order to produce the oscillation of the slider 3 on the radial plane of the lower needle cylinder 1, on which it lies, in the direction of oscillation which moves its longitudinal end provided with the hook-shaped tab 7, i.e., the end directed toward the needle 6, away from the bottom of the axial slot 2 of the lower needle cylinder 1 in which it is accommodated in order to disengage the slider 3 from the lower head 6*a* of the needle 6.

The selector 5 also has an elongated laminar body and is arranged on the opposite side with respect to the slider 3 relative to the connecting element 4.

The selector 5 has a portion 14 which protrudes between the connecting element 4 and the bottom of the axial slot 2 of the lower needle cylinder 1 in any position which can be assumed by the connecting element 4 during the operation of the machine, so that it is always possible to act, by means of the selector 5, on the connecting element 4.

In both embodiments, the selector 5, 105 can oscillate, by way of the action of at least one extraction element, on a radial plane of the lower needle cylinder 1 or needle cylinder 101 in order to cause the oscillation of the connecting element 4, 104 about the pivoting axis 11, 111 so as to produce the transfer of the movable heel 4*a*, 104*a* of the connecting element 4, 104 from the inactive position to the active position.

The side of the selector 5, 105 which is directed toward the bottom of the slot 2, 102 has a portion 15, 115 which is inclined with respect to the remaining part of said side indeed to allow said oscillation of the selector 5, 105.

The selector 5, 105 has, on its opposite side, in a region of its longitudinal extension which is spaced from its portion 14, 114 which is interposed between the bottom of the axial slot 2, 102 in which it is accommodated and the connecting element 4, 104, at least one pressable region 16*a*, 116*a*, 16*b*, 116*b*, which can be pushed toward the bottom of the axial slot 2, 102 in order to cause said oscillation of the selector 5, 105 and consequently cause the oscillation of the connecting element 4, 104 which produces the transfer of the movable heel 4*a*, 104*a* from the inactive position to the active position.

In the illustrated embodiments there are two pressable regions, respectively: a pressable region 16*a*, 116*a*, which is arranged at the longitudinal end of the selector 5, 105 which lies opposite the one directed toward the slider 3 or needle 106, and a pressable region 16*b*, 116*b*, which is arranged in an intermediate region.

The pressable region 16*b*, 116*b* can have a different extension or arrangement, in the longitudinal direction of the selector 5, 105, for the various selectors with which the machine is equipped, so as to allow a diversifiable action on the selectors 5, 105 depending on the extension of said pressable region 16*b*, 116*b*.

The extraction element that acts on the selectors 5, 105 in order to cause the transfer of the movable heel 4*a*, 104*a* of the connecting element 4, 104 from the inactive position to the active position comprises at least one presser 40, which faces the lateral surface of the needle cylinder 1, 101 and can engage the selectors 5, 105 in order to cause their transfer or retention in the position that corresponds to the active position of the movable heel 4*a*, 104*a* of the connecting element 4, 104.

The presser 40 can be fixed, i.e., rigidly coupled to the cam box, or can be movable on command along a radial direction with respect to the needle cylinder 1, 101 in order to pass from an activation position, in which it is arranged close to the needle cylinder 1, 101 in order to interfere with the selectors 5, 105, to a deactivation position, in which it is spaced from the needle cylinder 1, 101 so as to not interfere with the selectors 5, 105.

More particularly, in the illustrated embodiments there is a presser 40 of the fixed type which belongs to a needle selection device, for example of the type described in patent IT 1312277, which allows needle-by-needle selection, i.e., is capable of actuating independently of each other the various selectors of the machine, in particular even two selectors 5, 105 which are arranged in two contiguous axial slots 2, 102 of the needle cylinder 1, 101.

Said selection device has, for each axial slot 2, 102 of the needle cylinder 1, 101, a lever 41, which is arranged substantially horizontally, is supported by said needle cylinder 1, 101 and can perform a translational motion along a direction which is radial with respect to the needle cylinder 1, 101 and can oscillate on a radial plane of the needle cylinder 1, 101.

The movement of the lever 41 along the radial direction, i.e., toward or away from the axis 1*a*, 101*a* of the needle cylinder 1, 101, is used to act or not act, by way of said lever 41, on the pressable region 16*a*, 116*a* of the selector 5, 105, while the ability of the lever 41 to oscillate on the radial plane is used to produce the transfer of the lever 41 from an active position, in which it has one of its abutment sides, directed in the opposite direction with respect to the needle cylinder 1, 101, at the level of the presser 40, so engage it, to an inactive position, in which it has said abutment side arranged below the presser 40 so as to not engage it, and vice versa.

The engagement of the lever 41 in the active position with the presser 40 causes the translational motion of said lever 41 toward the axis 1*a*, 101*a* of the needle cylinder 1, 101. As a consequence of this translational motion, the lever 41 acts on the pressable region 16*a*, 116*a* of the corresponding selector 5, 105, which by oscillating on a radial plane of the needle cylinder 1, 101 causes, by means of its portion 14, 114, the oscillation of the connecting element 4, 104, which passes with its movable heel 4*a*, 104*a* from the inactive position to the active position.

The presser 40 is contoured with an initial guiding portion which gradually approaches the lateral surface of the needle cylinder 1, 101 along the direction of rotation of the needle cylinder 1, 101 about its own axis 1*a*, 101*a* with respect to said presser 40, so as to achieve a gradual engagement of the lever 41 with the presser 40, avoiding excessive impacts or stresses.

As an alternative or as an addition to the presser 40, it is possible to provide other pressers which can make contact directly with the regions 16*b*, 116*b* of the selector 5, 105.

In this case, by providing for example two types of selectors respectively with the regions 16*b*, 116*b* arranged at two different height levels and by arranging two pressers at the height levels that correspond to the height levels of these regions, it is possible to act in a diversified manner on the selectors of one type or on the selectors of the other type or on both types of selector.

As an alternative, it is possible to provide selection devices of another kind, of a known type, provided with at least one presser which can move on command with respect to the needle cylinder 1, 101 in order to pass from an activation position, in which it interferes with the selectors 5, 105, so as to cause their oscillation and therefore the transfer of the movable heel 4*a*, 104*a* of the connecting element 4, 104 from the inactive position to the active position, to a deactivation position, in which it does not interfere with the selectors 5, 105.

The regions around the needle cylinder 1, 101 at which there is a presser 40 or more generally a selection device which can act on the selectors 5, 105 so as to cause, if required, the transfer of the movable heel 4*a*, 104*a* of the connecting element 4, 104 from the inactive position to the active position are referenced hereinafter as selection points.

In the second illustrated embodiment, for the lower needle cylinder 1 there are five selection points, at each of which there is a selection device or presser, respectively a selection point 21, which is arranged directly upstream of a feed or drop, the position of which is indicated by the line A, of the machine along one direction of rotation of the needle cylinders about their own axis and to be used to select the needles that must knit at said feed A when the needle cylinders are actuated with said direction of rotation, indicated by the arrow 35, a selection point 22 arranged directly upstream of the feed A of the machine along the opposite direction of rotation of the needle cylinders about their own axis and to be used to select the needles that must knit at said feed A when the needle cylinders are actuated with said opposite direction of rotation, indicated by the arrow 36, a selection point 23 to be used during the transfer of the needles from one needle cylinder to the other, and two additional selection points 24, 25.

As mentioned above, a slider 3', a connecting element 4' and a selector 5', which are provided preferably like the slider 3, the connecting element 4 and the selector 5 described with reference to the lower needle cylinder 1, are arranged likewise in each of the axial slots of the upper needle cylinder 42. The parts of the slider 3', of the connecting element 4' and of the selector 5' that correspond to the parts that have already been described with reference to the slider 3, to the connecting element 4 and to the selector 5 have been designated by the same reference numerals.

It is possible to provide for the upper needle cylinder 42 also selection devices or pressers, similar to the ones described above, optionally in a smaller number in view of the fact that the need to select the needles when they are in the upper needle cylinder 42 is generally less frequent, which face the lateral surface of the upper needle cylinder 42 in order to act on the selectors 5' arranged in the upper needle cylinder 42. In particular, it is possible to provide: a selection point which is similar to the selection point 21, arranged directly upstream of the feed A of the machine along the direction of rotation 35 of the needle cylinders 1, 42 about their own axis 1*a* and to be used to select the needles 6 that must knit in the upper needle cylinder 42 at said feed A when the needle cylinders 1, 42 are actuated with said direction of rotation 35, and selection points which are similar to the two additional selection points 24, 25.

In a manner similar to what has been described with reference to the lower needle cylinder 1, there are slider actuation cams 8' and connecting element actuation cams 9' for the sliders 3' and for the connecting elements 4' arranged in the upper needle cylinder 42, and said cams are arranged around the lateral surface of the upper needle cylinder 42.

The slider actuation cams 8, 8' and the connecting element actuation cams 9, 9' constitute the set of actuation cams for the actuation elements 10, 10' of the needles 6 of the machine and define paths which can be engaged by the heels 3*a* of the sliders 3, 3' and by the movable heels 4*a*, in the active position, of the connecting elements 4, 4'. These paths are shaped in such a way as to cause the sliding of the sliders 3, 3' and of the connecting elements 4, 4', which engage them, along the axial slots of the corresponding needle cylinder in which they are accommodated. This sliding is needed for the formation of knitting by the needles 6 and for other operating conditions of the machine, such as for example the transfer of the needles 6 from the lower needle cylinder 1 to the upper needle cylinder 42 and vice versa, or to keep the sliders 3, 3' in a non-actuated or "off work" condition for the needle 6 that they engage when the needle cylinders are actuated with a rotary motion about their own axis with respect to the set of cams.

It should be noted that in the illustrated embodiment the set of cams of the machine according to the invention is composed exclusively of fixed cams.

FIGS. 5 to 9 illustrate a portion of a possible embodiment of the set of cams of the machine according to the invention proximate to a feed or drop A, at which the needles 6, if arranged in the lower needle cylinder 1, can form knitting both during the actuation of the needle cylinders of the machine in a direction of rotation 35 and in the opposite direction of rotation 36 about their own axis with respect to the set of cams.

For the sake of simplicity in presentation, it is assumed that the machine has only said feed A, without altering the fact that the machine can have multiple feeds or drops, depending on the requirements, which can be used to form knitting during the rotation of the needle cylinders about their own axis in at least one direction of rotation.

At said feed A, the following are indicated for the actuation cams of the sliders 8 of the lower needle cylinder 1: a central cam 26, a central complementary cam 47, an extraction (or lifting) cam 28, and a knockover cam 29 in the rotary motion of the needle cylinders in one direction, an extraction (or lifting) cam 30 and a knockover cam 31 in the rotary motion of the needle cylinders in the opposite direction.

An extraction (or lowering) cam 28' and a knockover cam 29' have been indicated between the slider actuation cams 8' of the upper needle cylinder.

Between the connecting element actuation cams 9 of the lower needle cylinder 1 there is a retraction (or lowering) cam 32, which is arranged between the extraction cam 28 and the central cam 26, and there is a retraction (or lowering) cam 33, which is arranged between the extraction cam 30 and the central cam 26 and are used to actuate the connecting elements 4 and therefore the needles 6 during the formation of knitting. In the illustrated embodiment, the retraction cams 32 and 33 are formed monolithically, but they might also be provided as separate cams.

Between the connecting element actuation cams 9' of the upper needle cylinder there is a retraction cam 34, which is arranged between the extraction cam 28' and the knockover cam 29', and there is an extraction cam 68, said cams being used to actuated the connecting elements 4' and therefore the needles 6 during the formation of knitting.

It should be noted that the extraction cams 28, 28' can always be engaged, during the actuation of the needle cylinders in the direction of rotation 35, by the fixed heel 3*a* of the slider 3, 3', and likewise the extraction cam 30 can always be engaged, during the actuation of the needle cylinders in the opposite direction of rotation 36, by the fixed heel 3*a* of the slider 3 in order to produce the movement of the corresponding needle 6 in an extracted off-work position, while the retraction cams 32, 34, during the actuation of the needle cylinders with a rotary motion in the direction of rotation 35, and the retraction cam 33, during the actuation of the needle cylinders in the direction of rotation 36, can be engaged exclusively by the movable heel 4*a* in the active position in order to bring the slider 3 or 3' to such a level as to engage with its fixed heel the knockover cam 29 or 29' or 31 in order to move the corresponding needle 6 from the extracted off-work position to the retracted position for forming a new loop of knitting, with lowering of the previously formed loop of knitting, as will become better apparent hereinafter.

In addition to the slider actuation cams 8, 8' and the connecting element actuation cams 9, 9', in the cam box there are pressers 53, 54, 57, 60 in the region of the slider actuation cams 8, 8', pressers 61, 62, 63, 64, 65, 66, 67 in the region of the connecting element actuation cams 9, 9', and pressers 55, 58 in the intermediate region between the slider actuation cams 8, 8' and the connecting element actuation cams 9, 9', which can act respectively on the sliders 3, 3' and on the connecting elements 4, 4' in order to cause their oscillation on a radial plane of the needle cylinders and whose functions will become better apparent hereinafter.

These pressers are fixed, i.e., rigidly coupled to the cam box or support, and therefore do not require any actuator for their operation.

Between the connecting element actuation cams 9, 9' there are cams which are mainly designed to actuate the connecting elements 4, 4' and therefore the sliders 3, 3' in order to actuate the transfer of the needles 6 from one needle cylinder to the other.

More particularly, the following are provided: a fixed upper lowering cam 51, which can be engaged by the connecting elements 4' arranged in the upper needle cylinder so as to cause the lowering of the sliders 3' into the position for engaging the corresponding needle 6, and a lower lifting cam 52, which can be engaged by the connecting elements 4 in order to lift the sliders 3 in the position that corresponds to the engagement of the corresponding needle 6.

The upper lowering fixed cam 51 and the lower lifting fixed cam 52 are arranged upstream of the selection point 23 along the direction of rotation 35 of the needle cylinders about their own axis with respect to the cam box.

Directly downstream of the upper lowering fixed cam 51 and of the lower lifting fixed cam 52, along this direction of rotation 35, between said cams and the selection point 23, there are pressers, respectively an upper closure presser 53 and a lower closure presser 54, against which the sliders 3' and the sliders 3 which might be, with their end which can be engaged with the upper head 6*a*' and with the lower head 6*a* of the corresponding needle 6, in the condition in which they oscillate away from the bottom of the corresponding axial slot 2, engage respectively.

Substantially in alignment with the selection device 23 there is an upper opening presser 55, which faces the lateral surface of the upper needle cylinder and can engage the heel 4*b* of the connecting elements 4' arranged in the upper needle cylinder so as to cause the oscillation of the sliders 3' in order to move their end directed toward the corresponding needle 6 away from the bottom of the corresponding axial slot 2.

Directly downstream of the selection point 23, again along the direction of rotation indicated by the arrow 35, the lateral surface of the lower needle cylinder 1 is faced by a lower lowering fixed cam 56, which can be engaged exclusively by the connecting elements 4 that are arranged in the lower needle cylinder 1 and have been moved with their movable heel 4*a* into the active position by said selection device 23.

Directly after the start of the lower lowering fixed cam 56 along the direction of rotation 35, the lateral surface of the upper needle cylinder is faced by an upper closure presser 57, which can engage the sliders 3' arranged in the upper needle cylinder so as to cause the oscillation of the sliders 3' in order to move their end directed toward the corresponding needle 6 toward the bottom of the corresponding axial slot 2.

After the lower lowering fixed cam 56 along the direction of rotation 35, the lateral surface of the lower needle cylinder is faced by a lower opening presser 58, which can be engaged exclusively by the heel 4*b* of the connecting elements 4 that are arranged in the lower needle cylinder and have their movable heel 4*a* in the inactive position, i.e., do not engage the lower lowering fixed cam 56. The lower opening presser 58 is designed to cause the oscillation of the sliders 3 which engage it in order to move their end directed toward the corresponding needle 6 away from the bottom of the corresponding axial slot 2.

Finally, downstream of the lower opening presser 58, again along the direction of rotation 35, the lateral surface of the upper needle cylinder 42 is faced by an upper lifting fixed cam 59, which can be engaged by the heel 4*a* of the connecting elements 4' which are arranged in the upper needle cylinder, and the lateral surface of the lower needle cylinder is faced by a lower closure presser 60, which can be engaged by the sliders 3 in order to return the sliders 3 on which the lower opening presser 58 has acted into the position in which their end directed toward the needle 6 is close to the bottom of the corresponding axial slot 2.

The set of cams of the machine in the first embodiment, at least proximate to a feed or drop of the machine, which is preferably capable of feeding the needles 106 both during the rotation of the needle cylinder 101 about its own axis 101*a* in one direction of rotation 35 and during the rotation of the needle cylinder 101 about its own axis 101*a* in the opposite direction of rotation 36, can be provided in a similar manner to the portion of the slider actuation cams 8 and of the connecting element actuation cams 9 that is delimited by the broken line 150 in FIGS. 4 to 7 with corresponding selection points 21 and 22 and pressers 62, 63.

In both embodiments, the extraction cams and the retraction cams or lifting cams and lowering cams, which belong to the connecting element actuation cams, have portions with a profile which is inclined with respect to an ideal plane which is perpendicular to the axis 1*a*, 101*a* of the needle cylinder 1, 42, 101 which can be engaged by the movable heel 4*a*, 4*a*', 104*a*, in the active position and the extraction element arranged in the selection point located at this inclined portion of one or more of the cams cited above and constituted by the presser 40 or by another presser acts, by means of the selector 5, 5', 105, on the connecting element 4, 4', 104 in order to keep the movable heel 4*a*, 4*a*', 104*a* in the active position substantially throughout the extension of the inclined portion of the corresponding extraction or retraction or lifting or lowering cam at which it is arranged.

Thanks to this fact, the machine according to the invention ensures high precision in the actuation of the needles even in the presence of high actuation speeds of the needle cylinder or cylinders with a rotary motion about their axis or axes and/or in the presence of vibration.

Operation of the machine according to the invention in the second embodiment is as follows.

FIGS. 5 to 9 illustrate the path followed by the heels 3*a*, 4*a*, 4*b* of a slider 3, 3' and of a connecting element 4, 4' which is associated therewith.

In order to distinguish the active position from the inactive position of the heels 4*a* of the connecting elements 4, 4', the heels 4*a* in the active position have been shaded, while the heels in the inactive position have not been shaded.

Figure 5:
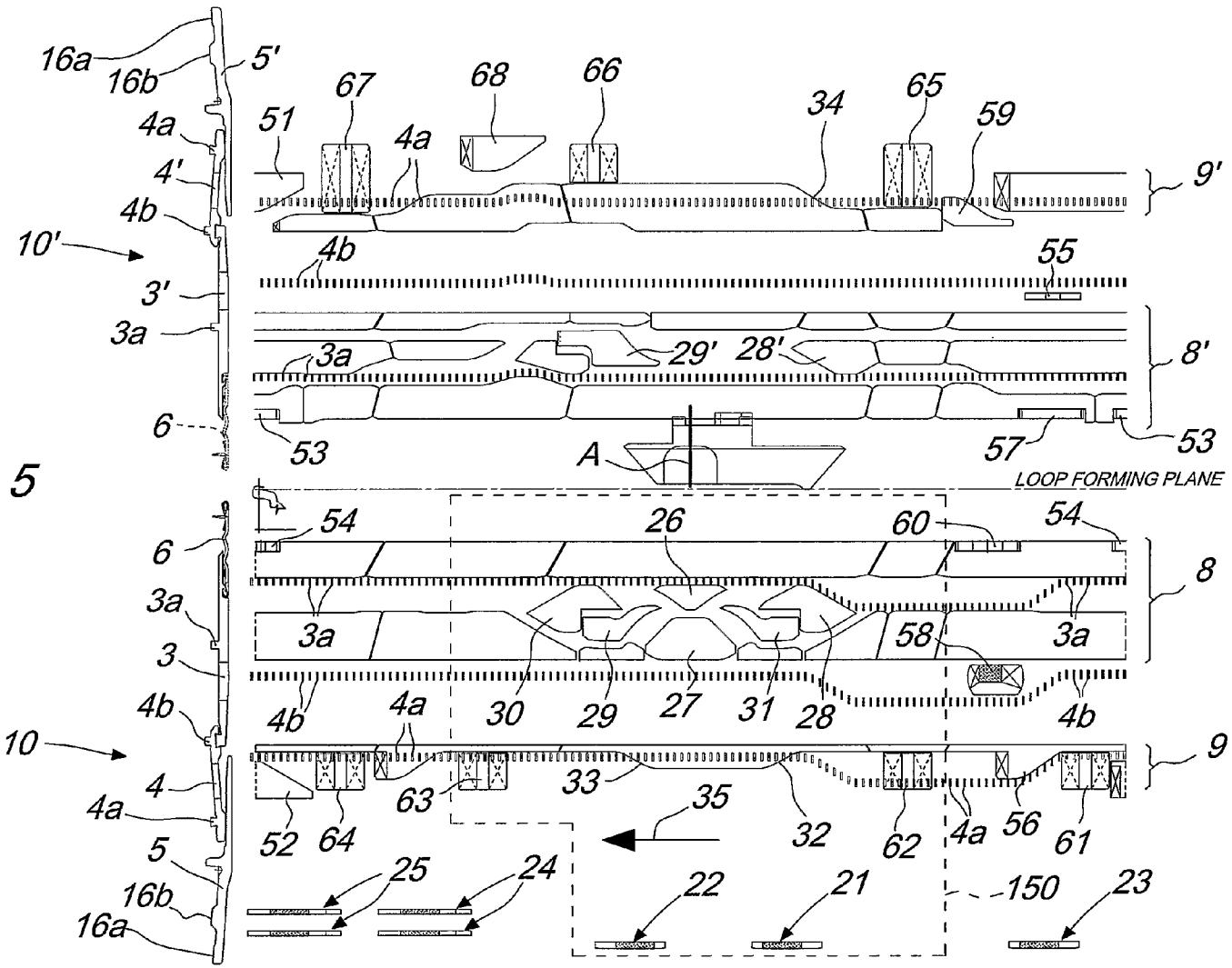

In the usual or more commonly used direction of rotation 35 of the needle cylinders about their own axis with respect to the cam box, when the needle 6, in the lower needle cylinder 1, engaged with the slider 3, does not have to form knitting at the feed A being considered, the selection device or presser arranged at the selection point 21 does not act on the selector 5 after the presser 62 has moved the heel 4*a* of the connecting element 4, which might be in the active position, into the inactive position. As a consequence of this fact, the connecting element 4 does not engage with its heel 4*a* the retraction cam 32 and therefore the slider 3, after it has engaged with its fixed heel 3*a* the extraction cam 28, is no longer lowered and passes above the central cam 26. The needle 6 therefore remains raised in an off-work position and does not engage the thread or threads dispensed at the feed A being considered, as shown in FIG. 5.

In the off-work position, the needle 6 is extracted with its upper tip 6*a* upwardly from the needle cylinder 1 in the position in which, if it were to knit, it would engage the thread or threads dispensed at the feed A or in a slightly more elevated position, so that any loop of knitting previously formed by the needle 6 arranges itself on the shank of the needle 6 below the latch.

It should be noted that this situation occurs even if there is an accidental interruption of the electric power supply of the machine which prevents the operation of the selection devices and resets the program being run. In this case, the failed intervention of the selection devices does not cause any damage to the machine, since the connecting element 4, in whatever point of its path it might be, when the intervention of the selection devices fails, if it has its heel 4*a* in the active position, as soon as it encounters a presser, is moved with its heel 4*a* into the inactive position and therefore, at the feed A being considered, the slider 3 passes with its heel 3*a* above the central cam 26 and is no longer lowered except after restoring the operation of the selection devices.

An operation which is similar to the one described occurs for the needle 6 when it is in the upper needle cylinder 42 and is engaged with the slider 3'. FIG. 5 also illustrates the path of the fixed heel 3*a* of the slider 3' and of the heels 4*a*, 4*b* of the connecting element 4' which corresponds to a needle 6, arranged in the upper needle cylinder 42, which must not be moved to knit at the feed A being considered.

When the needle 6, in the lower needle cylinder 1, has to form knitting at the feed A being considered, with the needle cylinders actuated with a rotary motion about their own axis with respect to the cam box in the direction of rotation 35, after the corresponding connecting element 4, which optionally might be with its movable heel 4*a* in the active position, has passed at the presser 62 which produced the safe passage of its movable heel 4*a* in the inactive position, it is returned with the heel 4*a* in the active position by the intervention of the selection device or presser arranged at the selection point 21.

Figure 6:
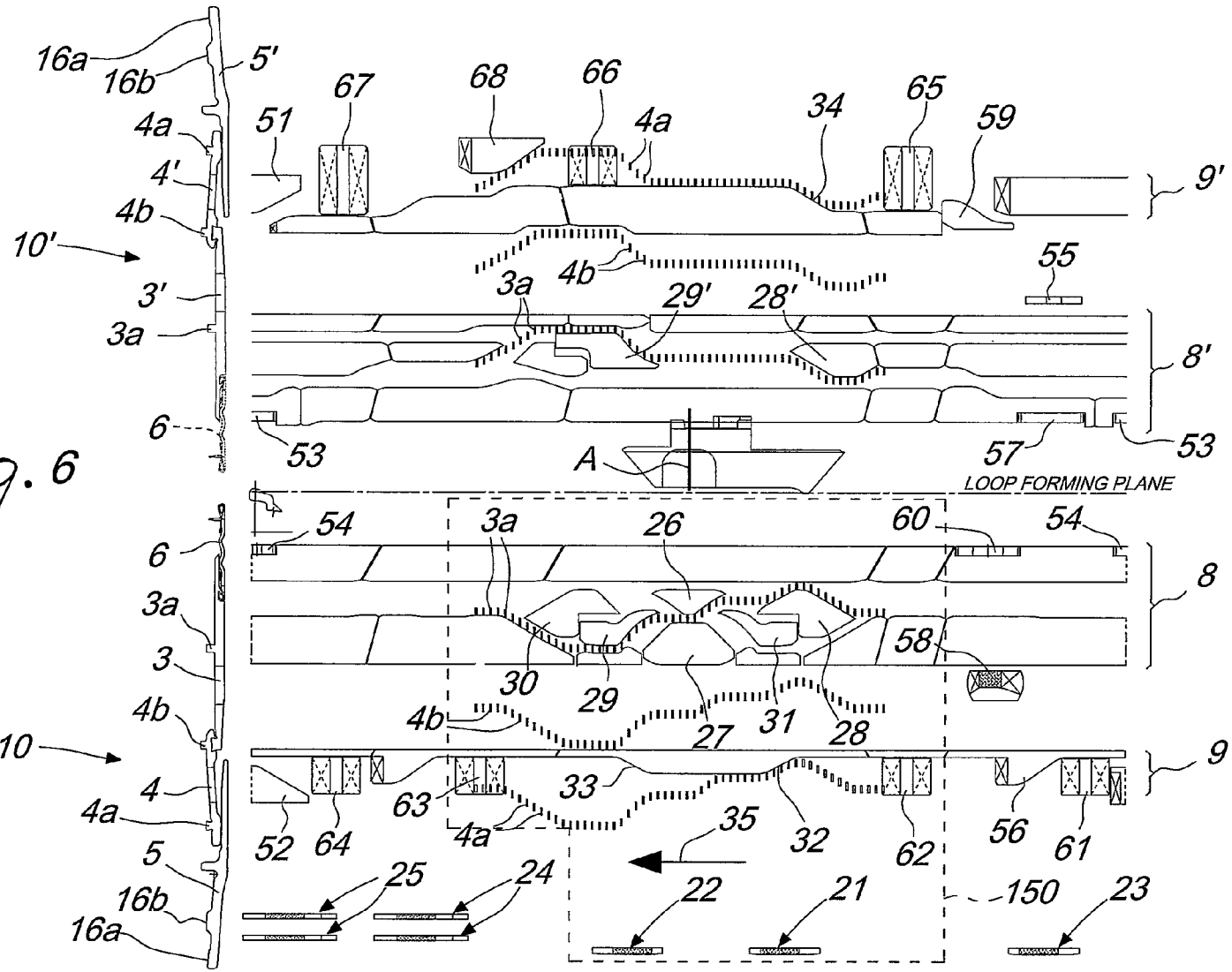

As a consequence of this fact, the slider 3, after being lifted by engagement with the extraction cam 28, is lowered as an effect of the engagement of the heel 4*a* with the retraction cam 32. For this reason, the heel 3*a* of the slider 3 engages the central cam 26 and therefore the knockover cam 29, as shown in FIG. 6. The corresponding needle 6 engages the thread or threads dispensed at the feed A being considered and forms a new loop of knitting, lowering the previously formed loop of knitting.

When instead a needle 6 engaged with the slider 3' in the upper needle cylinder 42 has to knit at the feed A being considered after the corresponding connecting element 4' which might have its movable heel 4*a* in the active position has passed at the presser 65 that caused the safe passage of its movable heel 4*a* into the inactive position, it is returned with its heel 4*a* into the active position by the intervention of a selection device or presser which faces the lateral surface of the upper needle cylinder 42 and is similar to the selection device or presser arranged at the selection point 21.

As a consequence of this fact, the slider 3', after being lowered by engagement with the extraction cam 28', is raised due to the engagement of the heel 4*a* with the retraction cam 34. For this reason, the heel 3*a* of the slider 3' engages the knockover cam 29'.

FIG. 6 also indicates the path of the heel 3*a* of the slider 3' and of the heels 4*a*, 4*b* of the connecting element 4' which corresponds to a needle 6 which is arranged in the upper needle cylinder 42 and must be moved to knit at the feed A being considered.

When the needle 6, arranged in the lower needle cylinder 1, must form knitting while the needle cylinders are actuated with a rotary motion about their own axis in the direction of rotation 36 which is opposite with respect to the usual direction, after the corresponding connecting element 4 which might have its heel 4*a* in the active position has passed at the presser 63 which caused the safe transfer of the heel 4*a* to the inactive position, it is returned with the heel 4*a* in the active position by the intervention of the selection device or presser arranged at the selection point 22.

Figure 7:
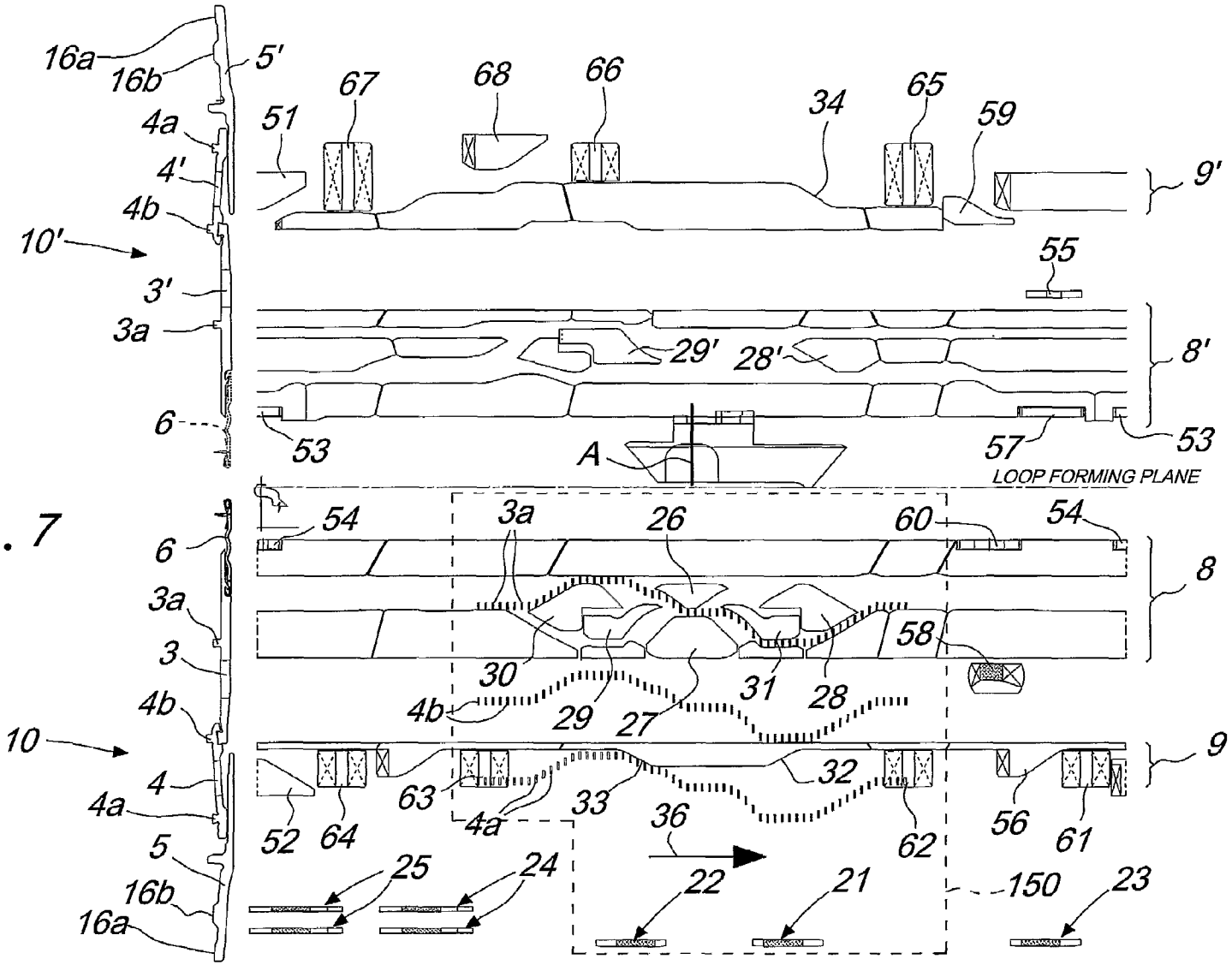

As a consequence of this fact, the slider 3, after being lifted by the engagement of its heel 3*a* with the extraction cam 30, is lowered due to the engagement of the heel 4*a* with the retraction cam 33. For this reason, the heel 3*a* of the slider engages the central cam 26 and therefore the knockover cam 31, as shown in FIG. 7. The corresponding needle 6 engages the thread or threads dispensed at the feed A being considered and forms a new loop of knitting, lowering the previously formed loop of knitting.

At the feed A being considered it is also possible to produce tuck stitches simply by causing the transfer of the needles that must form tuck stitches into the off-work position during the transit at the feed A being considered, causing instead the engagement of the heel 3*a* of the corresponding sliders 3 with the knockover cam 29 or 31, depending on the direction of rotation of the needle cylinders, during the subsequent transit. During the first transit, the previously formed loop of knitting arranges itself on the shank of the needle 6 below the latch, while another loop of knitting is rested on the shank of the needle 6. During the second transit, the needle 6 forms a new loop of knitting, which is knitted in with said two loops of knitting, which are simultaneously lowered.

In this manner it is possible to perform tuck-stitch knitting even with a single feed or drop.

By means of the selection devices 21 and 22 it is also possible to gradually reduce and gradually increase the needles that are moved to knit at the feed being considered, performing the knitting that is usually obtained in machines of the traditional type by using devices known as hammers or pickers and flaps, eliminating the need to resort to such devices.

Figure 8:
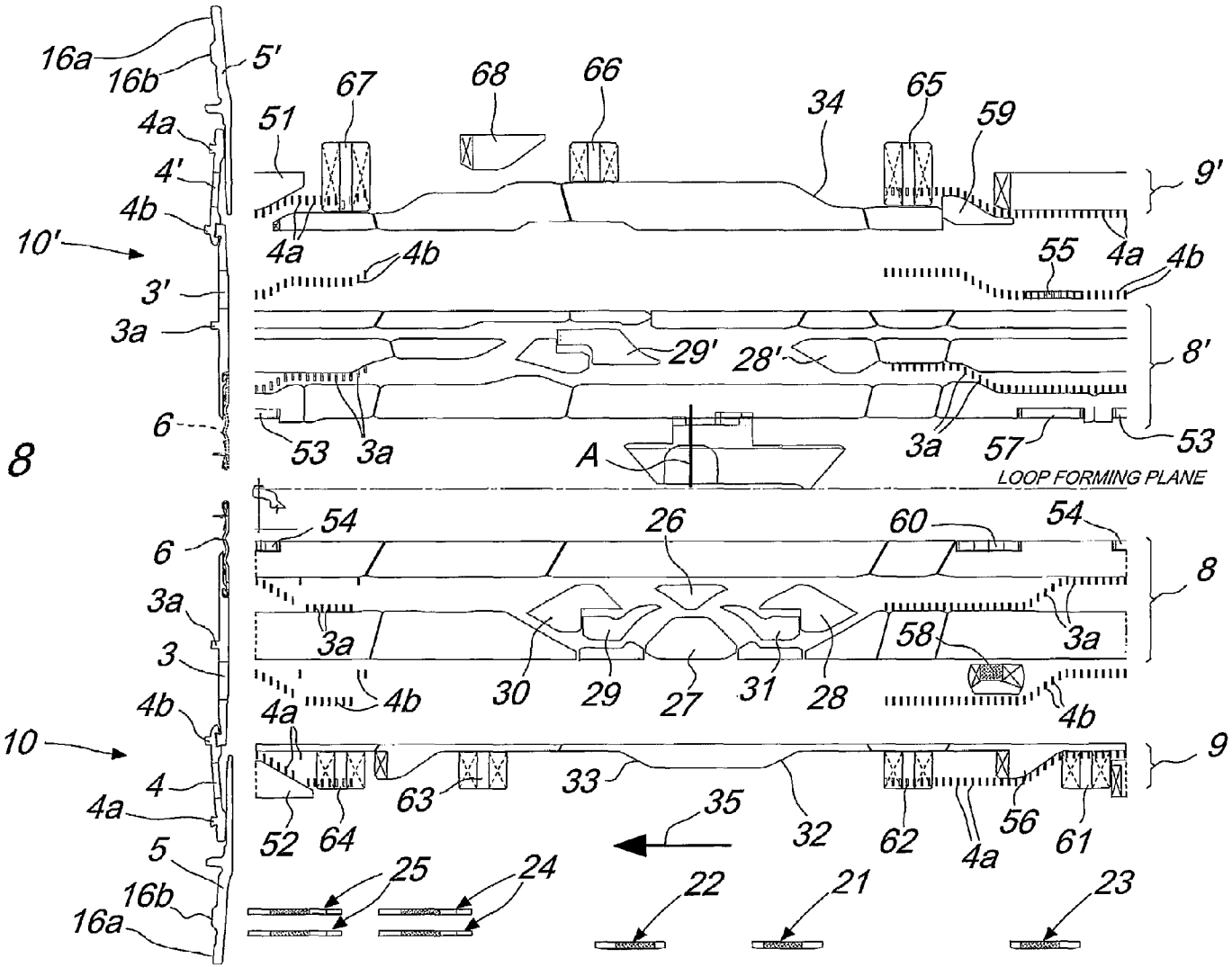
Figure 9:
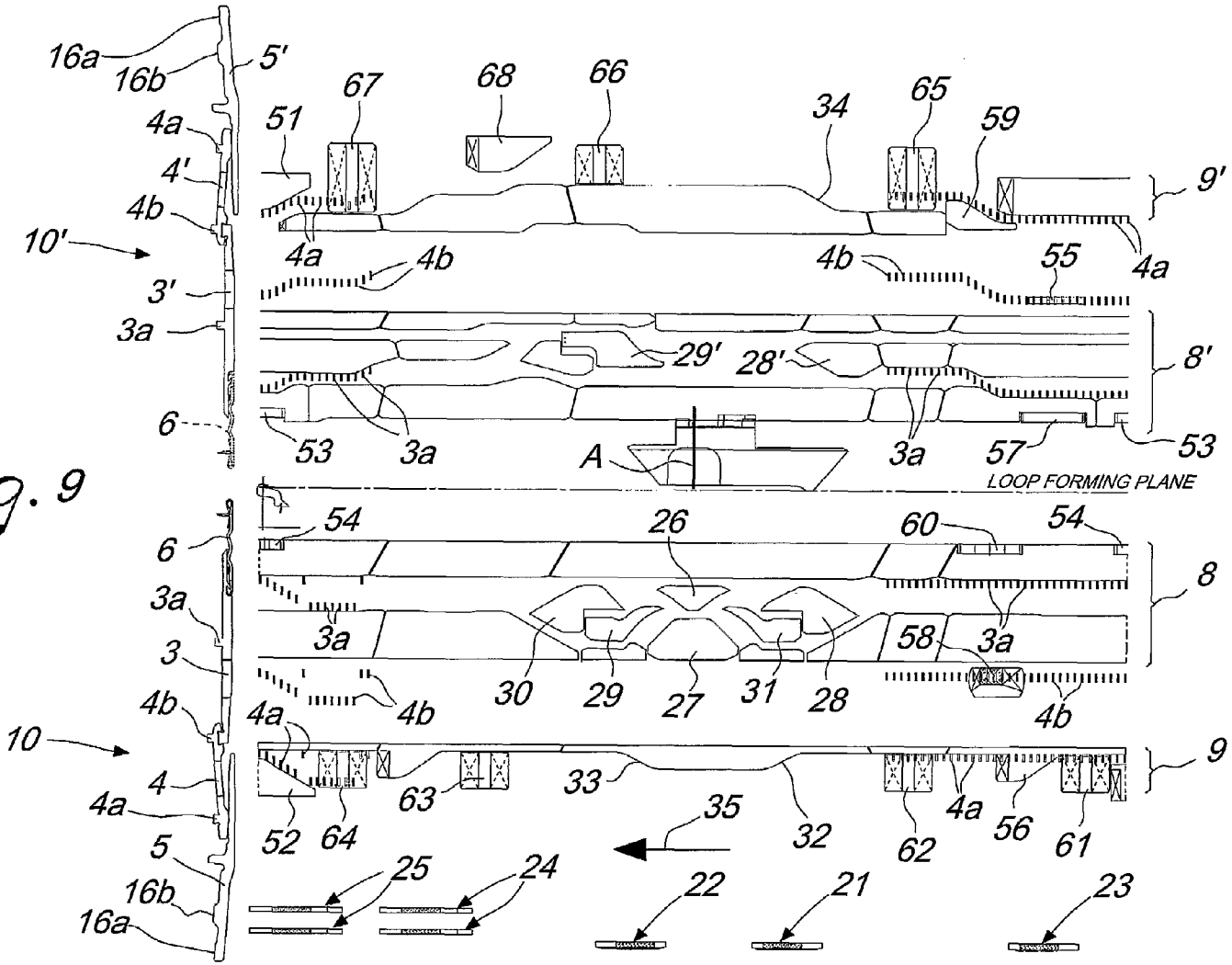

When it is necessary to transfer a needle 6 from one needle cylinder to the other, the start of the transfer operation is actuated by way of the selection devices arranged in the selection point 25 and in the corresponding selection point which faces the upper needle cylinder 42, which move all the connecting elements 4, 4' arranged in the lower needle cylinder 1 and in the upper needle cylinder 42 so that their heel 4*a* is in the active position, while the needle cylinders are actuated with a rotary motion in the direction of rotation 35, as shown in FIGS. 8 and 9.

The connecting elements 4 arranged in the lower needle cylinder 1 therefore engage with their heel 4*a* the lower lifting fixed cam 52 and the connecting elements 4' arranged in the upper needle cylinder 42 engage with their heel 4*a* the upper lowering fixed cam 51. The engagement of the connecting elements 4, 4' with these cams 51 and 52 causes the mutual approach of the sliders 3, 3' arranged in the upper needle cylinder 42 and in the lower needle cylinder 1, causing the overlap of their longitudinal end with the hook-shaped tab 7 on the corresponding head 6*a*, 6*a'* of the needle 6. For this reason, the sliders 3, 3' which have not been previously engaged with the corresponding needle 6, as a consequence of the particular shape of the hook-shaped tab 7 and of their sliding on the corresponding head 6*a*, 6*a'* of the needle 6, undergo an oscillation on the radial plane which causes the hook-shaped tab 7 to move away from the bottom of the corresponding axial slot 2 in which the slider 3, 3' is accommodated. Subsequently, the sliders that have undergone this oscillation engage the lower closure presser 54 or the upper closure presser 53, which cause the oscillation in the opposite direction of the sliders 3, 3', causing their engagement with the corresponding head 6*a*, 6*a'* of the needle. In this manner, a needle 6 is simultaneously engaged by the slider 3 and by the slider 3'.

At this point, by means of the selection device or presser arranged at the selection point 23, the connecting elements 4 that must transfer the needles 6 from the lower needle cylinder 1 to the upper needle cylinder 42 are selected. Directly before the selection point 23, the presser 61 causes the transfer of the heels 4*a* of the connecting elements 4 arranged in the lower needle cylinder 1 into the inactive position. The selection device 23 acts on the connecting elements 4 arranged in the lower needle cylinder 1 and connected to the sliders 3 which must remain engaged with the corresponding needle 6 so as to move said needle 6 to knit in the lower needle cylinder 1, causing the transfer of their heel 4*a* from the inactive position to the active position.

Substantially simultaneously with this selection operation, the sliders 3' arranged in the upper needle cylinder 42 undergo the action of the upper opening presser 55, which causes the oscillation of all the sliders 3' arranged in the upper needle cylinder 42 in the direction in which their hook-shaped tab 7 moves away from the bottom of the corresponding axial slot 2.

The heels 4*a* of the connecting elements 4 arranged in the lower needle cylinder 1 that have been moved into the active position therefore engage the lower lowering fixed cam 56 which causes their lowering and therefore the entrainment in the lower needle cylinder 1 of the needles 6 which are engaged with them. As soon as this downward movement has begun, the sliders 3' arranged in the upper needle cylinder 42 encounter the upper closure presser 57, which causes the oscillation of the sliders 3' in the direction which moves their engagement tab 7 toward the bottom of the corresponding axial slot 2, as shown in FIG. 8. This oscillation has no effect on the needles which in the meantime have begun their descent into the lower needle cylinder 1 as a consequence of the engagement of the corresponding connecting elements 4 with the lower lowering fixed cam 56 and instead determines the new engagement of the hook-shaped tab 7 of the sliders 3' with the corresponding needle, which is instead engaged by the sliders 3 arranged in the lower needle cylinder 1 which have not engaged with their heel the lower lowering fixed cam 56.

The sliders 3 that have not engaged the lower lowering fixed cam 56 therefore encounter the lower opening presser 58, which causes their oscillation in the direction which moves the hook-shaped tab 7 away from the bottom of the corresponding axial slot 2, causing the disengagement of these sliders 3 from the lower head 6*a* of the corresponding needle 6.

The connecting elements 4' arranged in the upper needle cylinder 42 therefore engage with their heel 4*a* the upper lifting fixed cam 59 which causes their upward movement and therefore also the upward movement of the corresponding needles, which have been disengaged from the slider 3 arranged in the lower needle cylinder 1, in the upper needle cylinder 42, as shown in FIG. 9.

At this point, the transfer of the needles from one needle cylinder to the other is completed and the sliders 3 connected to the connecting elements 4, arranged in the lower needle cylinder 1, which have engaged the heel 4*b* with the lower opening presser 58 are again made to oscillate in the opposite direction by engagement with another lower closure presser 60, which faces the lateral surface of the lower needle cylinder 1.

Operation of the machine in the first embodiment is similar to the one described with reference to the non-formation of knitting and to the formation of knitting with the needles arranged in the lower needle cylinder 101 with the machine in the second embodiment with reference to what is shown in FIGS. 5 to 7, with the difference that the actuation cams 8, instead of defining paths for the fixed heels 3*a* of sliders 3, define paths for the fixed heels 103*a* of the needles 106.

In practice it has been found that the machine according to the invention fully achieves the intended aim, since it allows to reduce or even eliminate the movable cams in the set of cams arranged around the needle cylinder or cylinders though allowing to execute substantially all the kinds of knitting that can be performed currently with circular knitting machines for hosiery of the traditional type.

A further advantage of the machine according to the invention is that it ensures precise operation even at high operating speeds and in the presence of vibration.

The machine thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Applications no. MI2006A000628 and MI2006A001378, from which this application claims priority, are incorporated herein by reference.

What is claimed is:

1. A circular knitting machine for hosiery or the like, comprising at least one needle cylinder which has a vertical axis and has, on its lateral surface, a plurality of axial slots, each of which accommodates a needle and a needle actuation element, said actuation element comprising:

at least one connecting element, which is provided, on its side directed toward the outside of the needle cylinder, with at least one movable heel; said connecting element being able to oscillate on a radial plane of the needle cylinder for the transfer of said movable heel from an active position, in which said movable heel protrudes radially from the corresponding axial slot of the needle cylinder to engage corresponding cams for actuating the connecting elements which face the lateral surface of the needle cylinder and define paths which can be followed by said movable heel, in the active position, as a consequence of the actuation of the needle cylinder with a rotary motion about its own axis with respect to said connecting element actuation cams, to an inactive position, in which said movable heel is contained in said axial slot of the needle cylinder so as to not engage said connecting element actuation cams, and vice versa; and a selector which is able to act on said needle actuation element in order to actuate the transfer of said movable heel of the connecting element from said inactive position to said active position, wherein said selector has a portion which protrudes between said connecting element and the bottom of the axial slot of the needle cylinder in which it is accommodated in any position which can be assumed by said connecting element during the operation of the machine, said selector is able to oscillate on said radial plane of the needle cylinder in order to actuate the transfer of said movable heel of the connecting element from said inactive position to said active position.

2. The machine according to claim 1, wherein said connecting element actuation cams comprise at least one extraction cam or one retraction cam which has a portion with a profile which is inclined with respect to an ideal plane which is perpendicular to the axis of the needle cylinder and can be engaged by said movable heel in the active position, and comprising, at said portion of the extraction cam or of the retraction cam, an extraction element which faces the lateral surface of the needle cylinder and acts, by means of said selector, on said connecting element in order to keep said movable heel of the connecting element in said active position substantially along the entire extension of said portion of the extraction cam or of the retraction cam.

3. The machine according to claim 1, wherein said extraction element comprises at least one presser which faces the lateral surface of the needle cylinder and can engage said selectors for their transfer or retention in the position that corresponds to the active position of said movable heel of the connecting element.

4. The machine according to claim 3, wherein said presser can move on command with respect to the needle cylinder in order to pass from an activation position, in which it interferes with said selectors, to a deactivation position, in which it does not interfere with said selectors.

5. The machine according to claim 1, wherein said connecting element is pivoted to the longitudinal end of the needle which lies opposite the tip or head of the needle about a pivoting axis which is perpendicular to said radial plane; said connecting element being able to oscillate about said pivoting axis with respect to said needle for the transfer of said movable heel from said active position to said inactive position or vice versa.

6. The machine according to claim 1, wherein said needle has, in an intermediate region of its longitudinal extension, a fixed heel which protrudes radially from the corresponding axial slot of the needle cylinder and can engage needle actuation cams which face the lateral surface of the needle cylinder and define paths which can be followed by said fixed heel as a consequence of the actuation of the needle cylinder with a rotary motion about its own axis with respect to said needle actuation cams.

7. The machine according to claim 1, wherein said needle actuation element comprises an intermediate element, which is arranged between said connecting element and the needle, arranged in a same axial slot of the needle cylinder; said connecting element being pivoted to said intermediate element about a pivoting axis which is perpendicular to said radial plane, said connecting element being able to oscillate about said pivoting axis with respect to said intermediate element for the passage of said movable heel from said active position to said inactive position or vice versa.

8. The machine according to claim 7, wherein said connecting element is pivoted, with one of its longitudinal ends, to the longitudinal end of said intermediate element which lies opposite the end that can engage the needle about a pivoting axis which is perpendicular to said radial plane.

9. The machine according to claim 8, wherein the pivoting between said needle or intermediate element and said connecting element is constituted by a protrusion which lies on the side of said needle or of said intermediate element which is directed away from the bottom of the axial slot of the needle cylinder in which it is accommodated and by a seat which rotatably accommodates said protrusion and is formed in said connecting element.

10. The machine according to claim 7, wherein said connecting element has, at its end connected to said needle or to said intermediate element, a second heel which protrudes radially toward the outside of the needle cylinder.

11. The machine according to claim 1, constituted by a double-cylinder machine with a lower needle cylinder and an upper needle cylinder arranged above and coaxially with respect to said lower needle cylinder; a plurality of mutually aligned axial slots being formed on the lateral surface of the lower needle cylinder and on the lateral surface of the upper needle cylinder; a needle actuation element being accommodated in each of the axial slots of the lower needle cylinder and of the upper needle cylinder; said needle actuation element comprising, at least for the lower needle cylinder:

a slider which constitutes said intermediate element and is provided, proximate to one of its longitudinal ends, with means for engaging the head of a needle;

said connecting element pivoted to the longitudinal end of said slider which lies opposite the end that can engage the needle;

said selector having a portion which protrudes between said connecting element and the bottom of the axial slot of the needle cylinder, in which it is accommodated, in any position which can be assumed by said connecting element during the operation of the machine; said selector being able to oscillate on a radial plane of the needle cylinder in order to actuate the transfer of said movable heel of the connecting element from said inactive position to said active position.

12. The machine according to claim 11, wherein said slider has, in an intermediate region of its longitudinal extension, a fixed heel which protrudes radially from the corresponding axial slot of the needle cylinder and can engage slider actuation cams which face the lateral surface of the needle cylinder and define paths which can be followed by said fixed heel as a consequence of the actuation of the needle cylinder with a rotary motion about its own axis with respect to said slider actuation cams.

13. The machine according to claim 11, wherein the actuation elements of the needles arranged in the upper needle cylinder also are provided with a fixed heel and with a heel which can move on command from an active position, in which it protrudes radially from the corresponding axial slot of the upper needle cylinder in order to engage corresponding actuation cams, to an inactive position, in which it is contained in the corresponding axial slot of the upper needle cylinder so as to not engage said corresponding actuation cams, and vice versa.

14. The machine according to claim 13, wherein the actuation elements of the needles arranged in the axial slots of the upper needle cylinder are provided substantially like the actuation elements of the needles arranged in the axial slots of the lower needle cylinder.

15. The machine according to claim 11, wherein said slider can oscillate on a radial plane of the needle cylinder for the engagement of the head of the needle or the release of the head of the needle by its longitudinal end which lies opposite the longitudinal end connected to said connecting element.

16. The machine according to claim 10, wherein said second heel can be pressed toward the bottom of the axial slot in order to produce the oscillation of said slider on said radial plane in the direction which moves its longitudinal end directed toward the needle away from the bottom of the axial slot of the needle cylinder in which it is accommodated.

17. The machine according to claim 11, wherein said selector has, in a region of its longitudinal extension which is spaced from its portion which is interposed between the bottom of the axial slot in which it is accommodated and said connecting element, at least one region which can be pressed toward the bottom of the axial slot in order to cause the oscillation of the selector and consequently the transfer of said movable heel of the connecting element from the inactive position to the active position.

18. The machine according to claim 3, wherein said presser is connected to at least one selection device which actuates the intervention of said presser on said selectors for their transfer into the position that corresponds to the active position of said movable heel of the connecting element.

19. The machine according to claim 18, wherein said at least one selection device is adapted to perform needle-by-needle selection, i.e., to actuate independently of each other said selectors by means of said presser.

20. The machine according to claim 11, further comprising fixed pressers which face laterally the needle cylinder and can engage said heels of the connecting element in order to actuate the oscillation of said slider and/or of said connecting element on said radial plane of the needle cylinder.

21. A needle actuation element for a circular knitting machine for hosiery or the like, designed to be accommodated in one of the axial slots formed in the lateral surface of the needle cylinder of the machine together with the needle to be actuated, further comprising:

at least one connecting element, which is provided, on its side designed to be directed toward the outside of the needle cylinder, with at least one movable heel; said connecting element being able to oscillate on a radial plane of the needle cylinder for the transfer of said movable heel from an active position, in which said movable heel protrudes radially from the corresponding axial slot of the needle cylinder to engage corresponding actuation cams of the connecting elements which face the lateral surface of the needle cylinder and define paths which can be followed by said movable heel, in the active position, as a consequence of the actuation of the needle cylinder with a rotary motion about its own axis with respect to said connecting element actuation cams, to an inactive position, in which said movable heel is contained in said axial slot of the needle cylinder so as to not engage said connecting element actuation cams, and vice versa; and a selector which is able to act on said needle actuation element in order to actuate the transfer of said movable heel of the connecting element from said inactive position to said active position, wherein said selector which has a portion designed to protrude between said connecting element and the bottom of the axial slot of the needle cylinder in which it is to be accommodated in any position which can be assumed by said connecting element during the operation of the machine, said selector is able to oscillate on said radial plane of the needle cylinder in order to actuate the transfer of said movable heel of the connecting element from said inactive position to said active position.

22. The actuation element according to claim 21, wherein said connecting element is pivoted to the longitudinal end of the needle which lies opposite the tip or head of the needle about a pivoting axis which is perpendicular to said radial plane; said connecting element being able to oscillate about said pivoting axis with respect to said needle for the transfer of said movable heel from said active position to said inactive position or vice versa.

23. The actuation element according to claim 21, wherein said needle actuation element comprises an intermediate element which is arranged between said connecting element and the needle, designed to be arranged in a same axial slot of the needle cylinder; said connecting element being pivoted to said intermediate element about a pivoting axis which is perpendicular to said radial plane, said connecting element being able to oscillate about said pivoting axis with respect to said intermediate element for the transfer of said movable heel from said active position to said inactive position or vice versa.

24. The actuation element according to claim 22, wherein the pivoting between said needle or intermediate element and said connecting element is constituted by a protrusion, which lies on the side of said needle or of said intermediate element that is directed away from the side designed to be directed toward the bottom of the axial slot of the needle cylinder in which it is to be accommodated, and by a seat which accommodates rotatably said protrusion and is formed in said connecting element.

25. The actuation element according to claim 23, wherein said connecting element has, at its end connected to said needle or to said intermediate element, a second heel which is designed to protrude from the axial slot of the needle cylinder in which it is to be accommodated.

26. A needle actuation element for a double-cylinder circular knitting machine for hosiery, according to claim 25, wherein said intermediate element is constituted by a slider which is provided, proximate to one of its longitudinal ends, with means for engaging the head of a needle, said connecting element being pivoted to the longitudinal end of said slider which lies opposite the end that can engage the needle.

27. The actuation element according to claim 26, wherein said slider has, in an intermediate region of its longitudinal extension, a fixed heel which is designed to protrude radially from the axial slot of the needle cylinder in which it is designed to be accommodated; said fixed heel being designed to engage slider actuation cams which face the lateral surface of the needle cylinder and define paths which can be followed by said fixed heel as a consequence of the actuation of the needle cylinder with a rotary motion about its own axis with respect to said slider actuation cams.

28. The actuation element according to claim 27, wherein said slider can oscillate on a radial plane of the needle cylinder for the engagement of the head of the needle or the release of the head of the needle by its longitudinal end which lies opposite the longitudinal end which is connected to said connecting element.

29. The actuation element according to claim 25, wherein said second heel can be pressed toward the bottom of the axial slot of the needle cylinder in which it is to be accommodated in order to actuate the oscillation of said slider in said radial plane in the direction which moves its longitudinal end directed toward the needle away from the bottom of the axial slot of the needle cylinder in which it is to be accommodated.

30. The actuation element according to claim 21, wherein said selector has, in a region of its longitudinal extension which is spaced from its portion designed to be interposed between the bottom of the axial slot of the needle cylinder in which it is to be accommodated and said connecting element, at least one region which can be pressed toward the bottom of the axial slot in order to cause the oscillation of the selector and consequently cause the passage of said movable heel of the connecting element from the inactive position to the active position.

* * * * *